US009487920B2

(12) United States Patent
Lang

(10) Patent No.: US 9,487,920 B2
(45) Date of Patent: Nov. 8, 2016

(54) DOUBLE FROG FOR TRACK CROSSINGS

(71) Applicants: voestalpine Weichensysteme GmbH, Zeltweg (AT); voestalpine VAE GmbH, Vienna (AT)

(72) Inventor: Alfred Lang, Wiesen (AT)

(73) Assignees: VOESTALPINE WEICHENSYSTEME GMBH, Zeltweg (AT); VOESTALPINE VAE GMBH, Vienna (AT)

( * ) Notice: Subject to any disclaimer, the term of this patent is extended or adjusted under 35 U.S.C. 154(b) by 83 days.

(21) Appl. No.: 14/307,637

(22) Filed: Jun. 18, 2014

(65) Prior Publication Data

US 2015/0001350 A1 Jan. 1, 2015

(30) Foreign Application Priority Data

Jun. 27, 2013 (AT) ..... GM215/2013

(51) Int. Cl.

| | |
|---|---|
| ***E01B 7/12*** | (2006.01) |
| ***E01B 7/18*** | (2006.01) |
| ***E01B 7/28*** | (2006.01) |

(52) U.S. Cl.

CPC . *E01B 7/12* (2013.01); *E01B 7/18* (2013.01); *E01B 7/28* (2013.01)

(58) Field of Classification Search

CPC ..... E01B 7/00; E01B 7/10; E01B 7/12; E01B 7/14; E01B 7/16

USPC ..... 246/454, 457, 458, 460, 461, 463, 468, 246/469

See application file for complete search history.

(56) References Cited

U.S. PATENT DOCUMENTS

2005/0145754 A1* 7/2005 Heinze ..... E01B 7/14 246/468

FOREIGN PATENT DOCUMENTS

DE 4224159 A1 1/1994

* cited by examiner

*Primary Examiner* — R. J. McCarry, Jr.

(74) *Attorney, Agent, or Firm* — Fitch, Even, Tabin & Flannery LLP

(57) ABSTRACT

In a double frog for track crossings with two opposing noses that are realized in a common material block and to which a check rail with at least one guide surface for a wheel is assigned, the check rail region featuring the guide surface is separably fastened on a check rail mounting that is realized in one piece with the material block.

8 Claims, 3 Drawing Sheets

DOUBLE FROG FOR TRACK CROSSINGS

CROSS REFERENCE TO RELATED APPLICATION

This application is a Non-Provisional U.S. Utility Patent Application which claims foreign priority from Austria Application GM 215/2013, filed Jun. 27, 2013, the complete disclosure of the aforesaid application is incorporated herein by reference.

BACKGROUND

The invention relates to a double frog for track crossings with two opposing noses that are realized in a common material block and to which a check rail with at least one guide surface for a wheel is assigned.

Track crossings are formed by the intersection of two railroad tracks in one plane and comprise two double frogs including wing rails and guide rails that have the function of substitutionally supporting and guiding the wheel at the location, at which the running rail needs to be interrupted due to the passage of the wheel flanges (so-called flange groove).

In the context of the present invention, the term track crossings also includes slip switches.

SUMMARY

In a double frog, the outer running rails of the intersecting tracks converge in an obtuse angle at the so-called knee of the frog and form the wing rails or joggled rails in this region. If the frog including wing rails consists of a casting (so-called monoblock-cast frog), e.g. of a hard manganese steel, the wing rails are typically connected to the abutting running rails by means of a welded joint. In this case, the noses approximately have the same length as the wing rails and likewise are connected to the following running rails, e.g., by means of welding.

The check rails may be realized in one piece with the casting. Alternatively, the check rails may also be supported on a separate support construction as described with reference to a switch, as well as with reference to a crossing, in DE 4224159 A1.

The check rails serve for guiding the respectively opposing wheel in the region that is unguided due to the interruption of the running edge. In this case, the check rail presses against the outer side of the wheel flange in order to avoid a collision of the opposing wheel flange when the wheel rolls onto the nose of the frog. The check rail therefore is subjected to significant wear such that it needs to be regularly checked with respect to the exceedance of upper wear limits and replaced, if so required. When a check rail is realized in one piece with a monoblock-cast frog as it is generally preferred for durability reasons, the entire double frog needs to be exchanged in order to replace the check rail, wherein this exchange is associated with significant effort, a long service interruption and high costs.

The present invention therefore aims to reduce the effort for the replacement of the check rail.

In a double frog of the initially described type, the invention proposes to separably fasten the region of the check rail that features the guide surface on a check rail mounting that is realized in one piece with the material block. This design provides a number of advantages. In comparison with a design, in which the check rail is fastened on a separate support construction, the number of components is reduced such that the effort for the installation of the double frog can be reduced. In comparison with a design, in which the entire check rail is cast together with the double frog, the invention provides the advantage that it is not necessary to exchange the entire double frog in order to replace the check rail, but rather only the region of the check rail that features the guide surface and is separably fastened on the material block of the double frog. In this way, the service life of the double frog is extended. The design of the check rail region that features the guide surface in the form of a separate, separably fastened component furthermore makes it possible to realize this component of a material that is especially adapted to the respective operating conditions.

In order to allow a particularly simple exchange of the part of the check rail that is subjected to significant wear, it is advantageously proposed that the separable fastening of the check rail region featuring the guide surface comprises screw joints.

According to a preferred enhancement of the invention, a particularly wear-resistant design is achieved if the check rail region featuring the guide surface consists of a wear-resistant material or carries a wear-resistant coating on the guide surface, wherein the wear-resistant material preferably has a Brinell hardness number of at least 350 HBW, particularly at least 400 HBW. Particularly suitable steel alloys are known, for example, under the brand names Hardox® and Dillidur®.

If the material block is conventionally realized in the form of a casting, it is proposed, according to a preferred enhancement of the invention, to cast the check rail mounting together with the casting. The check rail mounting therefore is integrated into the cast center block frog such that a particularly simple manufacture is achieved.

In the case of a casting, the wing rails of the double frog preferably can also be realized in one piece with the casting.

The invention can alternatively also be realized in a design, in which the wing rails of the double frog are connected to the material block on one or both sides by means of screw joints. The one-sided arrangement of the wing rails is in this case realized in a track crossing without switch. The wing rails are arranged on both sides of the double frog in slip switches, wherein the wing rails are in this case typically realized in the form of spring switch blades. The wing rails are preferably screwed to the material block with the aid of intermediately arranged lining elements in this case.

BRIEF DESCRIPTION OF THE DRAWINGS

The invention is described in greater detail below with reference to exemplary embodiments that are schematically illustrated in the drawings. In these drawings.

DETAILED DESCRIPTION

Figure 1:
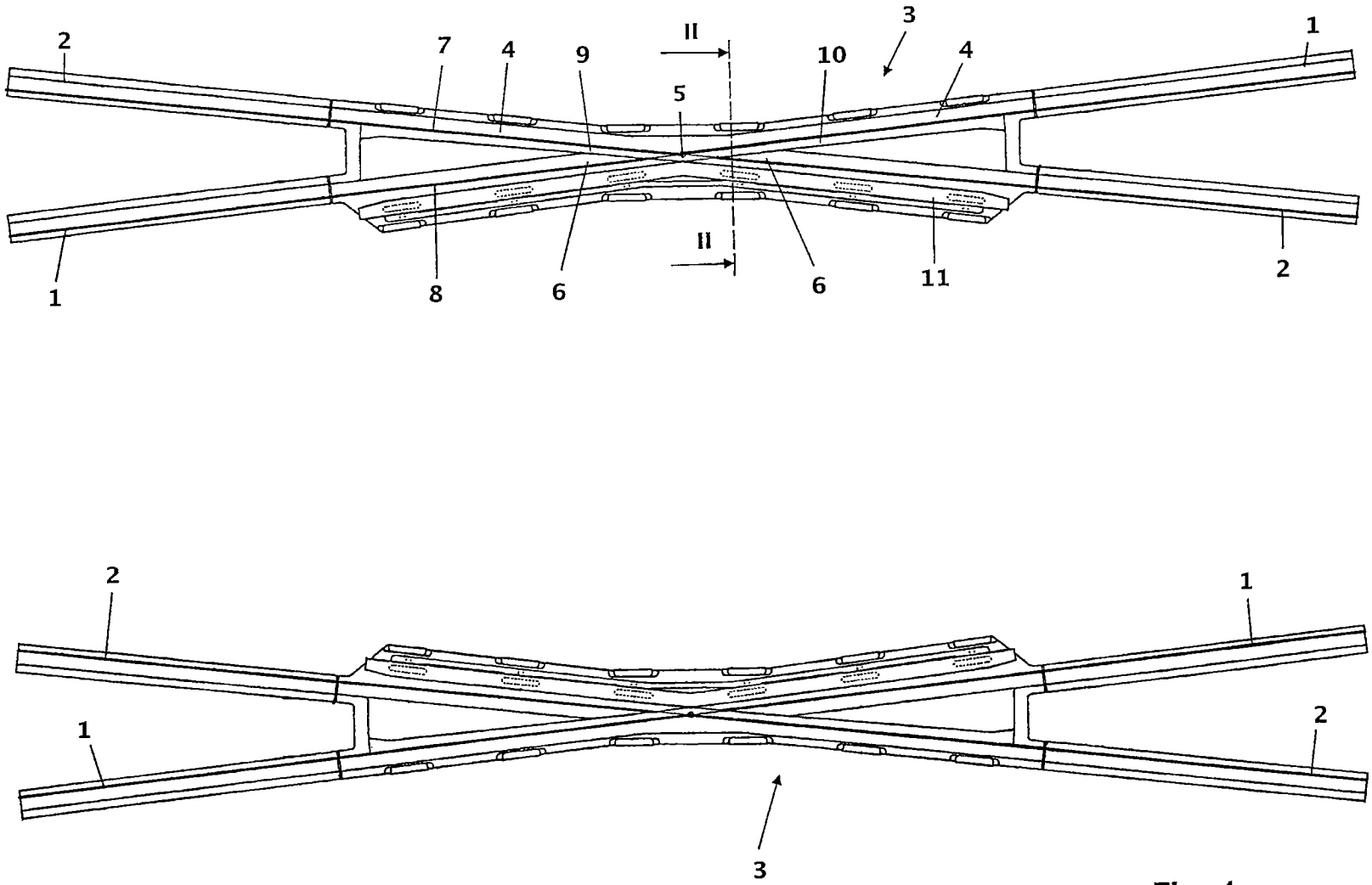
FIG. 1 shows a track crossing with two double frogs according to a first embodiment.

FIG. 1 shows a track crossing, in which two tracks intersect at an acute angle. The first track comprises parallel running rails 1. The parallel running rails of the second track are identified by the reference symbol 2. The running rails 1 and 2 are interrupted in the region of the track crossing and respectively connected to one another by means of a double frog 3. The design of the double frog 3 is described in greater detail below with reference to the double frog illustrated in the upper portion of FIG. 1, wherein the double frog illustrated in the lower portion of the drawing is realized diametrically opposed. The double frog 3 features wing rails 4 that respectively originate at the outer running rails 1 and 2 and converge at the knee 5 of the frog. The double frog 3 furthermore features two opposing noses 6. The wing rails 4 and the noses 6 are welded to the running rails 1 and 2. The running edges of the first track and the second track are identified by the reference symbols 7 and 8 and drawn with bold lines in FIG. 1, wherein it is obvious that the running edges 7 and 8 are interrupted due to the passage of the respectively other flange groove 9 or 10. In order to improve the guidance of the wheel flanges in the unguided region, a check rail 11 is provided, on which the outside of the wheel flange can be guided.

Figure 2:
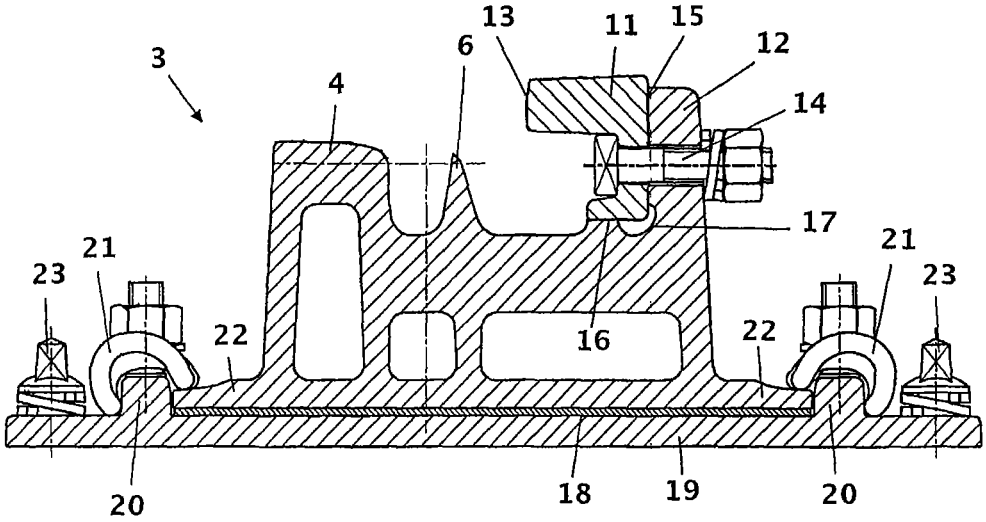
FIG. 2 shows a section along the line II-II in FIG. 1.

In the embodiment according to FIG. 1, the double frog is realized in the form of a casting of the type illustrated in FIG. 2, wherein the nose 6, the wing rail 4 and a check rail mounting 12 are realized in one piece. The actual check rail 11 with its guide surface 13 is separably connected to the check rail mounting 12 by means of a screw joint 14. In this case, the check rail 11 and the check rail mounting 12 feature cooperating vertical stopping faces 15, as well as cooperating horizontal supporting surfaces 16. A material recess in the form of an undercut 17 is provided in the intersecting region of the stopping face 15 and the supporting surface 16 of the check rail mounting 12 in order to reduce potentially occurring stress concentrations. The double frog 3 in the form of a casting is arranged on a ribbed base plate 19 with the aid of an elastic intermediate layer 18, wherein tension springs 21 are provided in the region of the ribs 20 in order to clamp the base 22 of the double frog against the ribbed base plate 19. Schematically indicated sleeper screws 23 are provided in order to fasten the ribbed base plate 19 on a not-shown sleeper.

Figure 4:
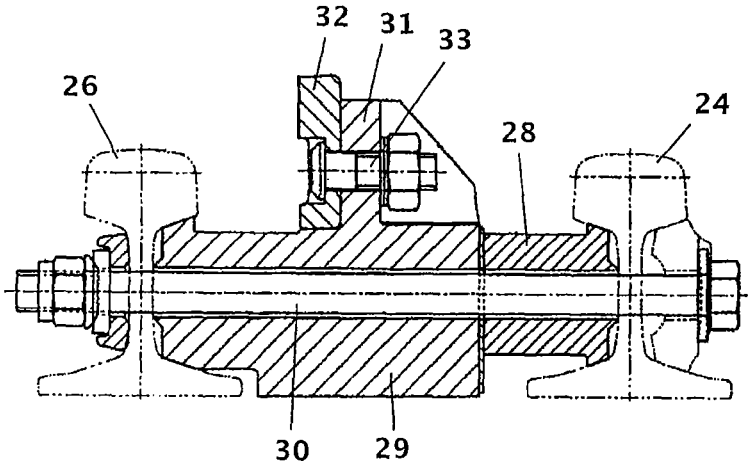
FIG. 4 shows a section along the line IV-IV in FIG. 3
Figure 5:
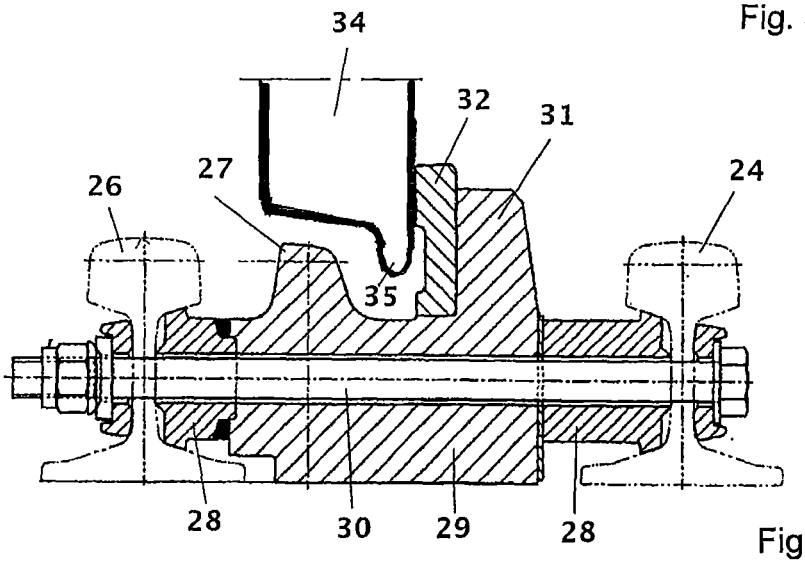
FIG. 5 shows a section along the line V-V in FIG. 3.
Figure 3:
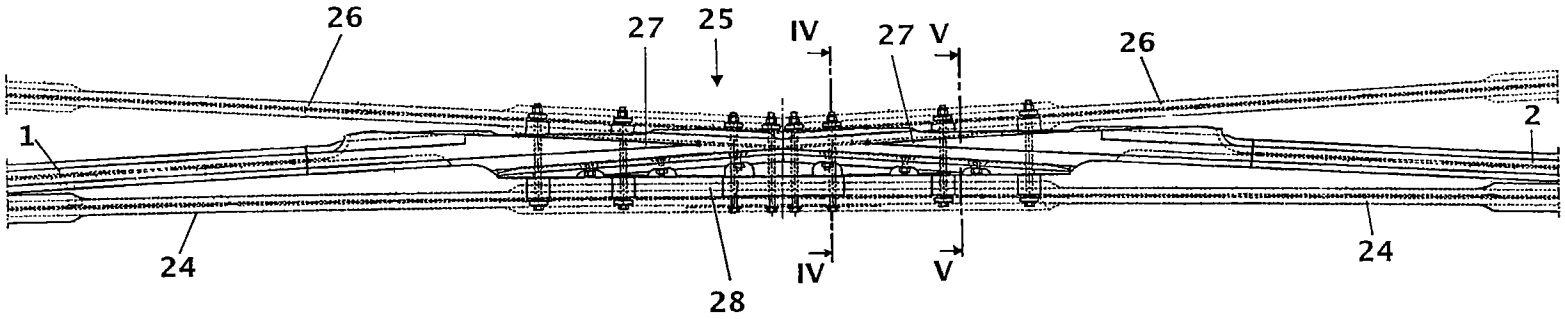
FIG. 3 shows a double frog according to a second embodiment.

The embodiment according to FIG. 3 features a modified design of a double frog 25 for a slip switch. This figure once again shows the running rails 1 and 2 of the first and the second track, as well as the outer wing rails 26 that are realized in the form of spring switch blades in this case. In addition, wing rails 24 that are realized in the form of spring switch blades and serve for transferring the wheel from the first track to the second track are also provided on the inner side in this case. The noses are identified by the reference symbol 27 and, in contrast to the embodiment according to FIG. 1, not realized in one piece with the respective wing rails 26 and 24. According to FIGS. 4 and 5, the frog is composed of a center block 29, to both sides of which the wing rails 24 and 26 are screwed with the aid of intermediately arranged lining elements 28. For this purpose, the center block 29 and the lining element 28 feature corresponding through-bores for the through bolt 30. According to the sectional representation in FIG. 5, the nose 27 and a check rail mounting 31, on which the check rail 32 is separably fastened by means of a screw joint 33, are realized in the center block 29. In addition, FIG. 5 also shows a wheel 34 with a wheel flange 35.

The invention claimed is:

1. A double frog for track crossings with two opposing noses that are realized in a common material block and to which a check rail with at least one guide surface for a wheel is assigned, wherein said common material block comprises a unitary one-piece casting, said unitary one-piece casting comprising a check rail mounting and the two opposing noses, said check rail mounting for receiving and for having fastened thereto a check rail, a check rail having a check rail region having a guide surface, the check rail region having the at least one guide surface is separably fastened on the check rail mounting, and said double frog having wing rails and a neck portion wherein the wing rails converge at the neck portion.

2. The double frog according to claim 1, wherein said double frog further comprises a screw joint wherein the check rail having the guide surface is fastened to the check rail mounting by the screw joint.

3. The double frog according to claim 1, wherein said unitary one-piece casting further comprises the wing rails.

4. The double frog according to claim 1, wherein said unitary one-piece casting has opposing inner and outer sides, the wing rails comprise inner and outer wing rails, and either said unitary one-piece casting further comprises one of said wing rails on the inner or outer side with the other wing rail connected to other of the inner side or outer side of the casting by means of screw joints or both the inner and outer wing rails are each respectively connected to the inner and outer sides of the casting by means of screw joints.

5. The double frog according to claim 4, wherein the double frog further includes intermediately arranged lining elements, and wherein the wing rails are screwed to the unitary one piece casting with the aid of the intermediately arranged lining elements.

6. The double frog according to claim 1, wherein the check rail region having the guide surface consists of a wear-resistant material or carries a wear-resistant coating on the guide surface, wherein the wear-resistant material has a Brinell hardness number of at least 350 HBW.

7. The double frog according to claim 1, wherein the check rail region having the guide surface consists of a wear-resistant material or carries a wear-resistant coating on the guide surface, wherein the wear-resistant material has a Brinell hardness number of at least 400 HBW.

8. A double frog for a slip switch for track crossings, the double frog having a common one-piece unitary material block that has two opposing noses, has opposing inner and outer sides, and has a check rail mounting to which a check rail with at least one guide surface for a wheel is assigned, an inner wing rail and an outer wing rail, wherein the inner wing rail and outer wing rail of the double frog are respectively connected to the opposing inner and outer sides of the one-piece unitary material block by means of screw joints, the outer wing rail comprising outer switch blades, and the inner wing rail comprising inner switch blades, the inner wing rail and outer wing rail for transferring a wheel from a first track to a second track, and a check rail having a check rail region having at least one guide surface that is fastened to the check rail mounting.

* * * * *